US007137936B1

(12) United States Patent
Shaw et al.

(10) Patent No.: US 7,137,936 B1
(45) Date of Patent: Nov. 21, 2006

(54) ADJUSTABLE EXERCISE DEVICE

(76) Inventors: Tracy K. Shaw, 1719 E. 1100 South, Flat Rock, IN (US) 47234; Gordon J. Waligorski, 303 W. Front St., Delphi, IN (US) 46923

( * ) Notice: Subject to any disclaimer, the term of this patent is extended or adjusted under 35 U.S.C. 154(b) by 183 days.

(21) Appl. No.: 10/914,600

(22) Filed: Aug. 9, 2004

(51) Int. Cl.
*A63B 21/045* (2006.01)
*A63B 21/00* (2006.01)

(52) U.S. Cl. ..... 482/127; 482/92; 482/79; 482/101

(58) Field of Classification Search ..... 482/79, 482/80, 92, 100, 102, 126, 427, 114, 115, 482/72, 101; 446/464
See application file for complete search history.

(56) References Cited

U.S. PATENT DOCUMENTS

| | | | | | |
|---|---|---|---|---|---|
| 2,512,911 | A * | 6/1950 | Benice | 482/72 |
| 4,149,713 | A | 4/1979 | McLeod | |
| 4,229,001 | A * | 10/1980 | Roman | 482/79 |
| 4,304,402 | A | 12/1981 | Ripp | |
| 4,637,379 | A | 1/1987 | Saringer | |
| 4,773,398 | A | 9/1988 | Tatom | |
| 4,953,541 | A | 9/1990 | Parker, Jr. | |
| 5,020,795 | A | 6/1991 | Airy et al. | |
| 5,035,233 | A | 7/1991 | Ruf | |
| 5,066,005 | A | 11/1991 | Luecke | |
| 5,072,929 | A * | 12/1991 | Peterson et al. | 482/72 |
| 5,147,264 | A * | 9/1992 | Braathen | 482/118 |
| 5,385,524 | A | 1/1995 | Jahoda | |
| 5,540,642 | A * | 7/1996 | Sprague | 482/123 |
| 5,569,124 | A | 10/1996 | Raynie et al. | |
| 5,607,381 | A | 3/1997 | Endelman | |
| 5,700,232 | A | 12/1997 | Clausen et al. | |
| 5,702,324 | A | 12/1997 | Wendel et al. | |
| 6,042,523 | A * | 3/2000 | Graham | 482/121 |
| 6,261,212 | B1 | 7/2001 | Vallone et al. | |
| 6,443,874 | B1 | 9/2002 | Bennett | |
| 6,458,061 | B1 * | 10/2002 | Simonson | 482/103 |
| 6,527,685 | B1 | 3/2003 | Endelman et al. | |
| 6,569,065 | B1 | 5/2003 | Menold et al. | |
| 6,585,625 | B1 | 7/2003 | Ferguson | |
| 6,659,922 | B1 * | 12/2003 | Yu | 482/127 |
| 2002/0025891 | A1 | 2/2002 | Colosky, Jr. et al. | |
| 2002/0086779 | A1 * | 7/2002 | Wilkinson | 482/118 |
| 2002/0132706 | A1 | 9/2002 | Sleamaker et al. | |
| 2003/0119635 | A1 | 6/2003 | Arbuckle et al. | |
| 2003/0125170 | A1 * | 7/2003 | Vernon | 482/124 |

* cited by examiner

*Primary Examiner*—Stephen R. Crow
*Assistant Examiner*—Allana Lewin
(74) *Attorney, Agent, or Firm*—Mathew R P Perrone, Jr.

(57) ABSTRACT

An exercise device is easily adjusted in resistance by changing a first cassette therein to a second cassette having a different resistance or in exercise type by changing the support mechanism.

14 Claims, 10 Drawing Sheets

ADJUSTABLE EXERCISE DEVICE

This invention relates to an adjustable exercise device; and more particularly to an adjustable exercise device, which varies the resistance of the exercise device or the part of the body which may be exercised.

BACKGROUND OF THE INVENTION

Many exercise devices are known. Whether the exercise device is used for recreational or fitness purposes, or for the more critical physical therapy purposes, adding flexibility to an exercise device, which otherwise has a single use, is greatly desired. For example, if the resistance of such an exercise device can be changed efficiently with a compact device, great advantages can be obtained.

With an exercise device, it is very desirable to have a device, which can be used in many different ways. One of the key factors in accomplishing this matter involved being able to change the resistance of the exercise device. Another key factor is being able to adjust an exercise device in order to change the part of the body to be exercised. Either class of adjustments is difficult.

If the adjustment of resistance can be more efficiently and more easily changed, the advantages of such an exercise device improve in a geometric progression. Those greater advantages will be obtained from the changes in the resistance of the exercise device.

This exercise device can be adjusted to correspond to a set of desired workout capabilities of a particular person. Also, the resistance of the work out provided by the device can be changed as a particular person changes or develops physical ability. Such changes can also be effective when a different person desires to use the same device.

Such a simple factor in adjusting the resistance of an exercise device does not exist. It thus becomes clear that a compact resistance variation device for a compact exercise device is an extremely desirable device.

Also, for a person having a desire to or being required to exercise a different part of the body, it is extremely useful to adjust the exercise device to provide a workout for a different part of the body. If a device can be adapted efficiently to exercise a different part of the body, even further advantages are obtained.

With an exercise device being able to adjust a variety of different body parts, the device may become more useful for a physical therapy procedure. Such an improved device can facilitate rehabilitation for a person requiring the same. This is especially true if the exercise device can be programmed in order to require the patient to stick to a required routine.

For example, if a specific exercise is required with a specific weight, there is no effective way to be sure that the patient sticks to the required exercise program. It is too easy for a patient to deviate from a prescribed exercise at a prescribed weight. If the exercise can avoid that deviation, great advantages are obtained.

Thus, a device, which facilely provides exercises both for different parts of the body and at different resistances, gives a great advantage. This is especially true for physical therapy. To a lesser extent, but still as an important issue, this exercise device is suitable for fitness exercise.

SUMMARY OF THE INVENTION

Among the many objectives of this invention is the provision of an exercise device, which facilitates exercise.

A further objective of this invention is the provision of an exercise device, which allows for an easily changed resistance value.

Yet a further objective of this invention is the provision of an exercise device, which has a compact resistance changing mechanism.

A still further objective of this invention is the provision of an ergonomic exercise device.

Another objective of this invention is the provision of an exercise device, which saves space.

Yet another objective of this invention is the provision of an exercise device with a low-profile, loading position.

Still, another objective of this invention is the provision of an accessible exercise device.

Also, an objective of this invention is the provision of an accessible exercise device, which may be easily cleaned.

A further objective of this invention is the provision of an exercise device, which allows for an easily changed exercise mechanism.

Yet a further objective of this invention is the provision of an exercise device, which adjusts to exercise a specific body part.

A still further objective of this invention is the provision of an exercise device, which changes to exercise a desired body part.

Another objective of this invention is the provision of an exercise device, which allows for an easily variable resistance.

Yet another objective of this invention is the provision of an exercise device suitable for use in physical therapy.

Still, another objective of this invention is the provision of an exercise device capable of exercising different body parts for physical therapy purposes.

Also, an objective of this invention is the provision of an exercise device, which has programmable resistance for physical therapy purposes.

A further objective of this invention is the provision of an exercise device, which substantially requires the patient to stick an exercise program.

Yet a further objective of this invention is the provision of an exercise device, which facilitates health maintenance.

A still further objective of this invention is the provision of an exercise device, which facilitates physical therapy.

These and other objectives of the invention (which other objectives become clear by consideration of the specification, claims and drawings as a whole) are met by providing an exercise device which is easily adjusted in resistance by changing a first cassette therein to a second cassette having a different resistance or an exercise type by changing the mechanism or exercise fixture.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
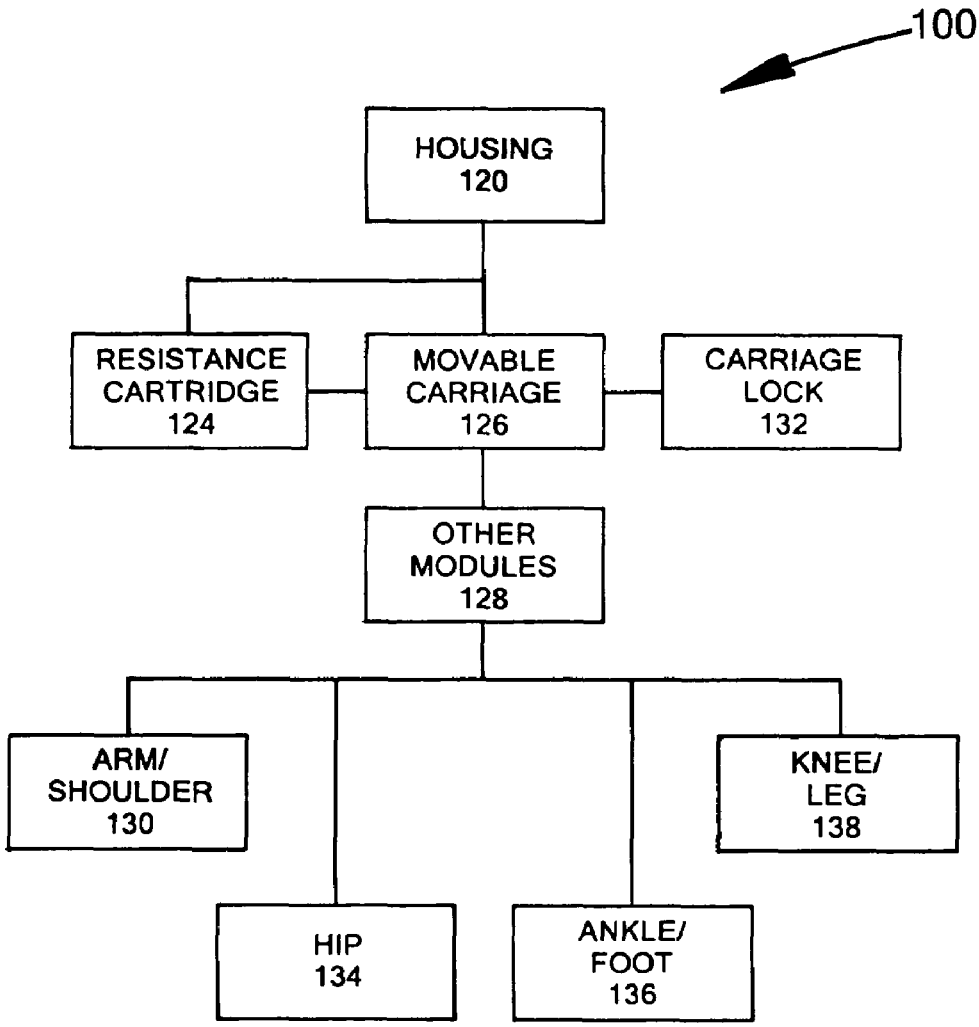
FIG. 1 depicts a block diagram of the exercise device 100 of this invention.

Within an exercise device of this invention, the exercise device has a housing adapted to receive a variable resistance device or a variable body part exercise fixture. These factors render this exercise device effective for the recreational or fitness purposes, or for the more critical physical therapy purposes, adding flexibility to an exercise device.

With the cassette providing the desired resistance and the body part exercise mechanism directing body movement, the doctor or the therapist can provide a person with the exercise device and at least one selected cassette. With the selected cassette, the doctor or therapist can be more sure that the patient is using the exercise device properly at the right resistance with the proper motion.

A resistance of the exercise device is changed by replacing the resistance cassette, which is matable with the housing for the exercise device. The body part exercised depends on the exercise fixture connected to the housing. The exercise fixture, in combination with the housing provides for a desired movement of the body part to be exercised, thereby making the exercise effective and avoiding deviation from the desired exercise.

This cassette structure provides a simplified structure, permitting the resistance of the exercise device to be changed as each cassette is changed. Thus, it is possible to provide a series of cassettes and have a selection of resistance levels, which are suitable for adjusting the exercise resistance of an exercise device. For a person having low strength level, a cassette with a low resistance level may be inserted in the exercise device. As the person's strength increases or decreases, the change of the cassette can change the resistance of the device, appropriately.

Clearly, the exercise device for exercising a particularly desired group of muscles or part of the body can be developed, or an existing device can be modified to receive the resistance cassettes of this invention. With the section of the exercise device adapted to receive the various cassettes of this invention, it becomes possible to change the level of exercise provided by the device.

With any suitable mounting mechanism, an appropriate cassette can be selected for insertion into a compatible exercise device. Thus, changing the resistance for the exercise device is accomplished in a relatively simple matter of changing a cassette.

The outer casing of the cassette may be made of any suitable material. In a preferred form, the casing material is plastic. This material may be marked in any desired fashion in order to indicate the resistance of the cassette. Preferably, the cassette is color-coded to indicate the resistance of the cassette. In other words, a different color for each cassette of a different resistance permits an easy determination of the resistance provided by that cassette when the cassette is placed in the housing.

An interlocking mechanism may attach one cassette to another and permit the resistances of at least two cassettes to be combined. In this manner with the combined cassettes used in the exercise device, a wider variety of resistances can be provided with fewer cassettes, by using various combinations thereof.

By resistance is meant that a cassette may have an effective weight effect, especially for a specific exercise. For example, a two kilogram cassette provides the effect of lifting a two kilogram weight, for exercise, physical therapy or other purposes. While each cassette has the same general outer dimensions, the inner workings or parts thereof can provide different resistances or weight level for any desired exercise.

Also clearly, the exercise device for exercising a particularly desired group of muscles or part of the body can be developed, or an existing device can be modified to receive an exercise fixture of this invention. The exercise fixture sets the pattern of exercise for the particular body part to be exercised within a set of desired parameters. Two important parameters are movement and resistance.

With FIG. 1, exercise device 100 has an exercise housing 120. To housing 120 may be secured a resistance cartridge 124 in order to adjust a resistance provided by movable carriage 126. To movable carriage 126 may be secured an exercise fixture or exercise module 128. Exercise module 128 may be designed to have a body part secured therein and to use housing 120 to move that body part within a desired range of motion. Resistance cartridge 124 can address a variety of resistances for the exercise device 100.

With the combination of the resistance cartridge 124 on the housing 120 with the desired exercise module 128, the prescribed exercise is more likely to be carried out in a proper fashion. With the exercise module 128 and the resistance cartridge 124 at the prescribed weight, it becomes almost impossible to deviate from a prescribed exercise.

As is clear from FIG. 1, exercise module 128 may be any number of devices. Arm shoulder device 130, hip device 134, ankle foot device 136 and knee leg device 138 are possible options. Movable carriage 126 may have a carriage lock 132 to lock or release movable carriage 126 as desired.

Figure 2:
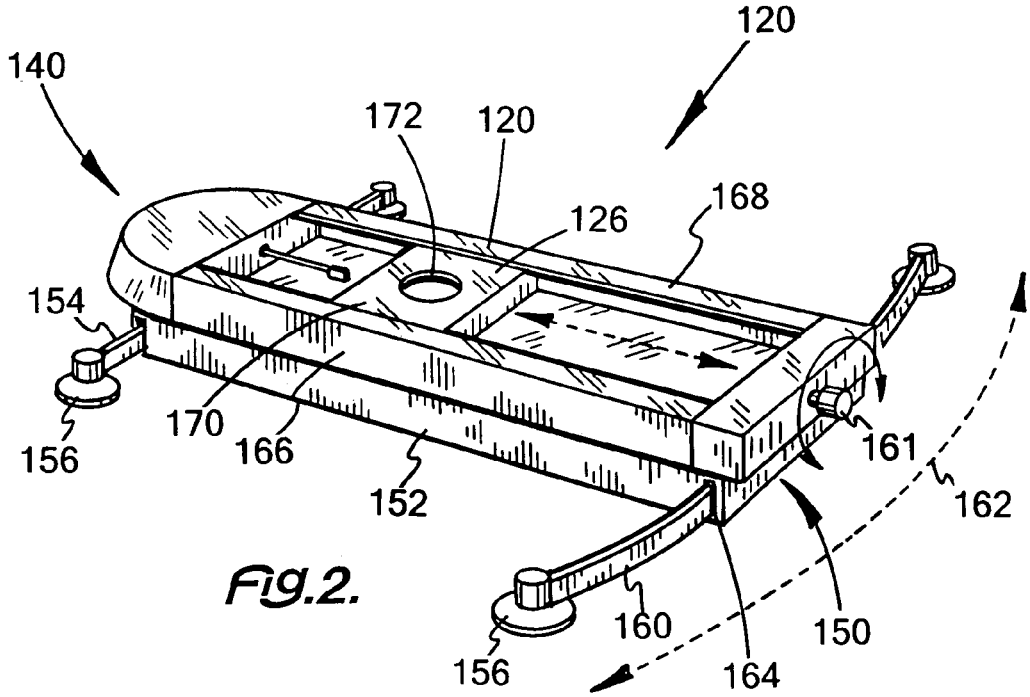
FIG. 2 depicts a perspective view of a housing 120 for the exercise device 100 of this invention.

With the addition of FIG. 2, housing 120 has a fixed end 140 and a sliding end 150 connected by a mounting support 152. Fixed end 140 of mounting support 152 includes a support bar 154. Support bar 154 has a gripping device in the form of suction cups 156 at each end thereof. Sliding bar 160 receives sliding end 150 of mounting support 152. Like support bar 154, sliding bar 160 has suction cups 156 at each end thereof. Sliding bar 160 cooperates with twist locking device 161, so that housing 120 can be releasably locked in a desired position for a specific exercise. Sliding bar 160 has an arc 162, and receives sliding slot 164 of mounting support 152.

Housing support 120 has a first side rail 166 and a second side rail 168. Mounted therebetween is a slide member 170 as an adaptation of the movable carriage 126 of FIG. 1. Slide member 170 has an exercise receiver 172 centrally located therein and adapted to receive exercise module 128 of FIG. 3 or similar modules.

Figure 3:
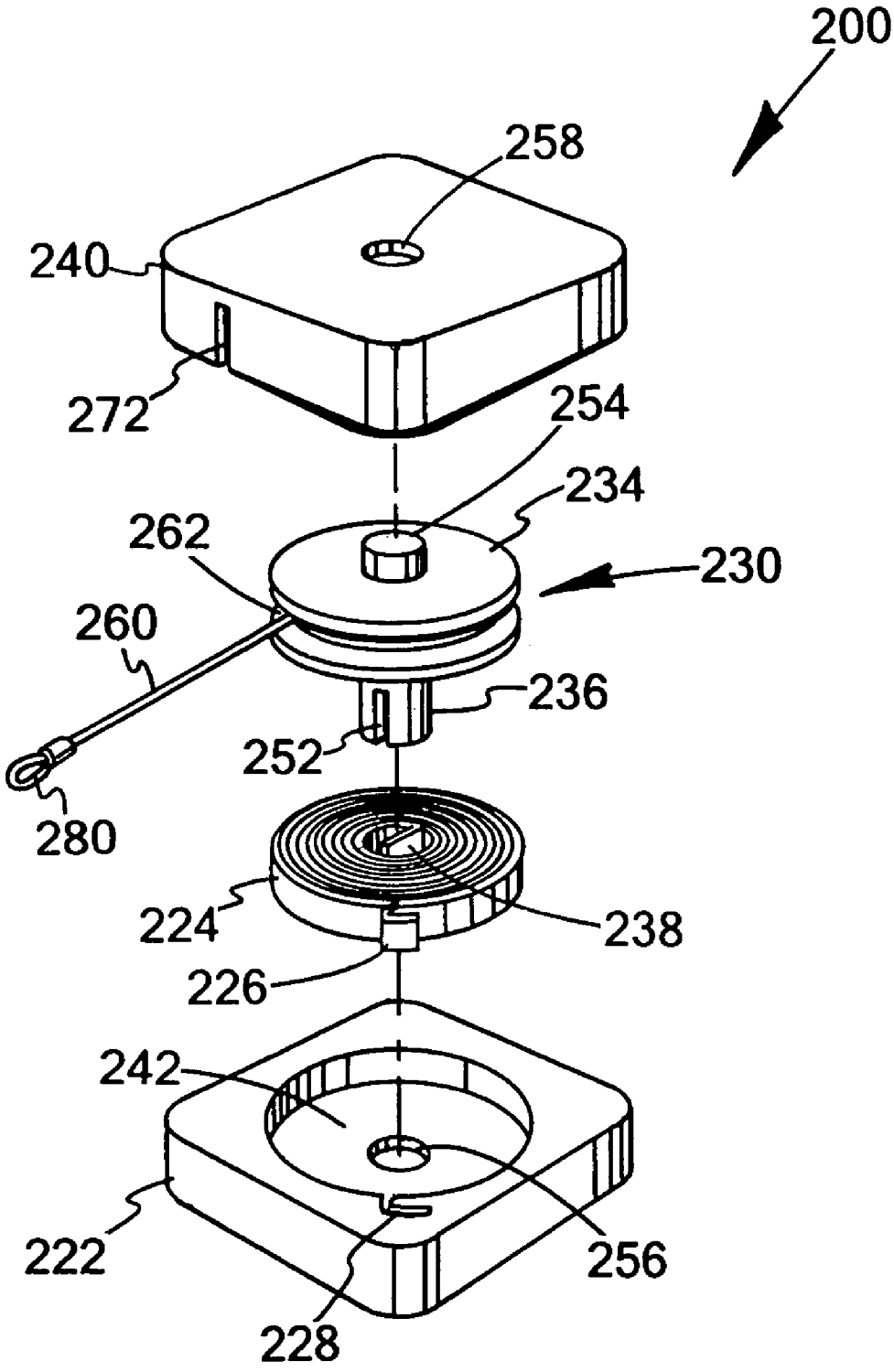
FIG. 3 depicts an exploded, perspective view of a pinned, spring cassette assembly 200 of this invention.

Adding FIG. 3 to the consideration, the exercise housing 120 with a resistance cartridge 124 in this embodiment has a stacked pulley over spring assembly 200 and can be made to have various weight resistance levels. The stacked pulley over spring assembly 200 has an internal lower housing 222, which contains a resistance spring 224. The resistance spring 224 has an outer end 226 retained by internal slot 228 in lower housing 222. A pulley assembly 230 is also mounted in the internal lower housing 222.

Within the lower housing 222, pulley assembly 230 may be mounted with pulley 234 thereof solidly mounted on shaft 236. Pulley 234 and shaft 236 are thus free to rotate or pivot within the lower housing 222 and upper housing 240. The resistance spring 224 is retained in shaft slot 252 of shaft 236 at inner spring end 238 thereof.

A flexible cable 260 is both mounted on the hub 262 of pulley 234 and wound therearound. The flexible cable 260 is passed through the upper housing slot 272 in the upper housing 240. The stacked pulley 234 is placed over resistance spring 224, which in turn is received within lower spring receiver 242 of lower housing 222.

Resistance spring 224 is preferably a circular spring wound upon itself. Outer end 226 of resistance spring 224 fits into internal slot 228 in lower housing 222. Inner end 238 is mounted in shaft slot 252 of pulley shaft 236. With outer and 226 and inner end 238 so secured, tension can be applied to resistance spring 224, for resistance of exercise device 100.

Pulley shaft 236 has a shaft slot 252 adjacent internal lower housing 222 and a solid end 254 adjacent to upper housing 240. Shaft slot 252 is received in lower housing aperture 256, while solid end 254 is received in upper housing aperture 258.

Cable end 280 is fastened to any selected exercise module. The combination of pulling cable end 280 from the assembly of lower housing 222 and upper housing 240 through the housing slot 272 in the upper housing 240 winds resistance spring 224 and may provide the resistant force determined by a doctor or therapist. That resistance force can be easily changed by replacing the pinned, spring cassette assembly 200.

Figure 4:
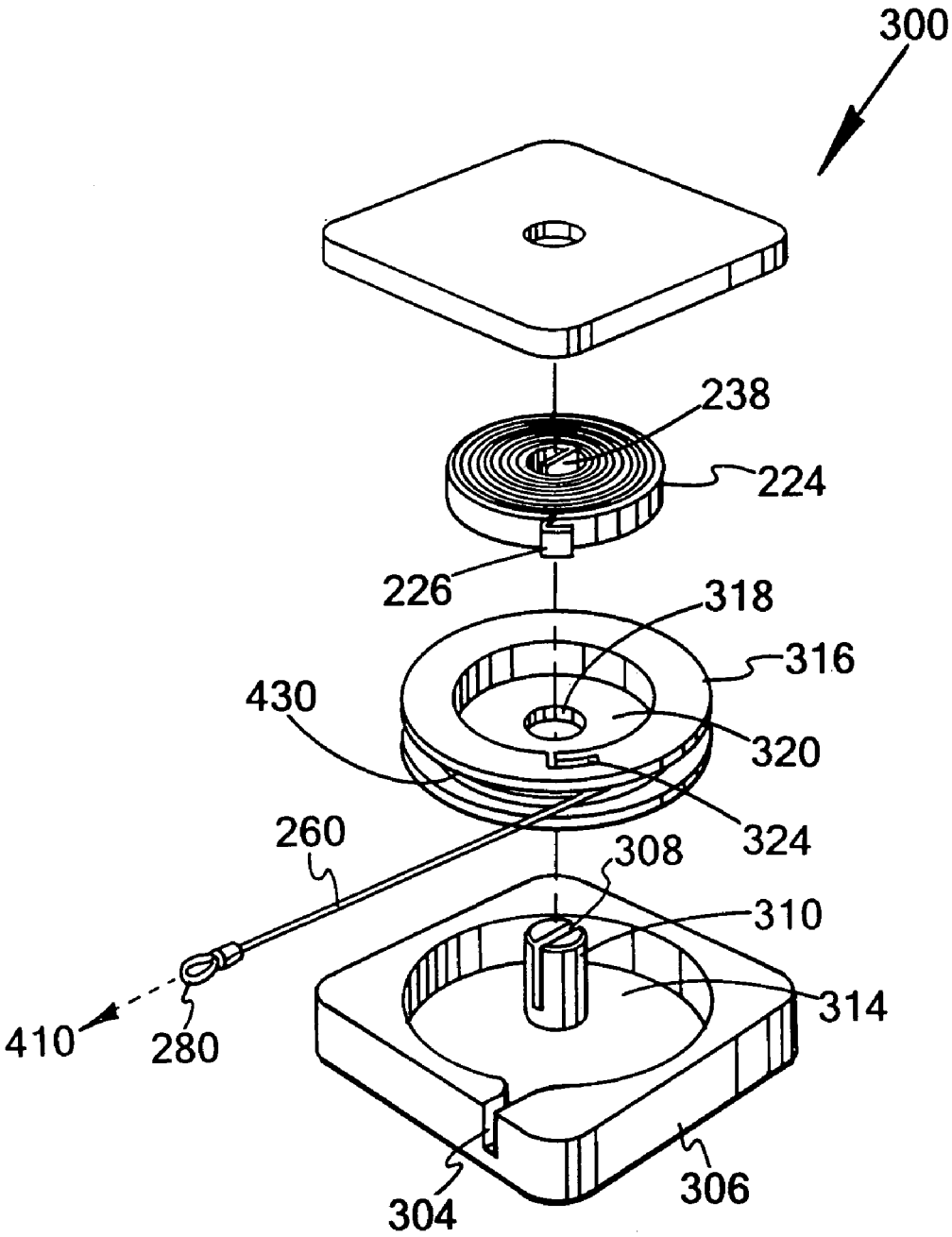
FIG. 4 depicts a perspective view of an exploded, perspective view of a reel, spring cassette assembly 300 of this invention.

Adding FIG. 4 to the consideration, spring 224 inside pulley assembly 300 includes slotted pulley 316, with center aperture 318 to receive fixed shaft 310. Slotted pulley 316, includes a spring receiver 320 to hold resistance spring 224 therein. Slotted pulley 316 includes edge spring slot 324 to receive outer end 226 of resistance spring 224.

Outer slot lower housing 304 receives slotted pulley 316 with resistance spring 224 therein over fixed shaft 310 into pulley housing 314. The inner spring end 238 fits into fixed slot 308 as slotted pulley 316 is placed over fixed shaft 310. With slotted pulley 316 thus positioned, tension can be applied to resistance spring 224, for resistance of exercise device 100.

As in FIG. 3, resistance spring 224 is preferably a circular spring wound upon itself. However, in FIG. 4, outer end 226 of resistance spring 224 fits into inside edge slot 324 of slotted pulley 316. Inner end 238 is mounted in fixed slot 308 of fixed shaft 310 as pulley assembly 300 is placed thereover. With outer end 226 and inner end 238 so secured, tension can be applied to resistance spring 224, for resistance of exercise device 100.

Flexible cable 260 is both mounted on hub 430 of pulley 316 and wound therearound. The flexible cable 260 passes through slot 304 in the lower housing 306. Cable end 280 is fastened to any selected exercise module 410. The combination of pulling cable end 280 through slot 304 in the lower housing 306 wind resistance spring 224 and provides the resistance for specified by a doctor or a therapist. As resistance spring 224 changes, the exercise device 210 changes in resistance.

Figure 5:
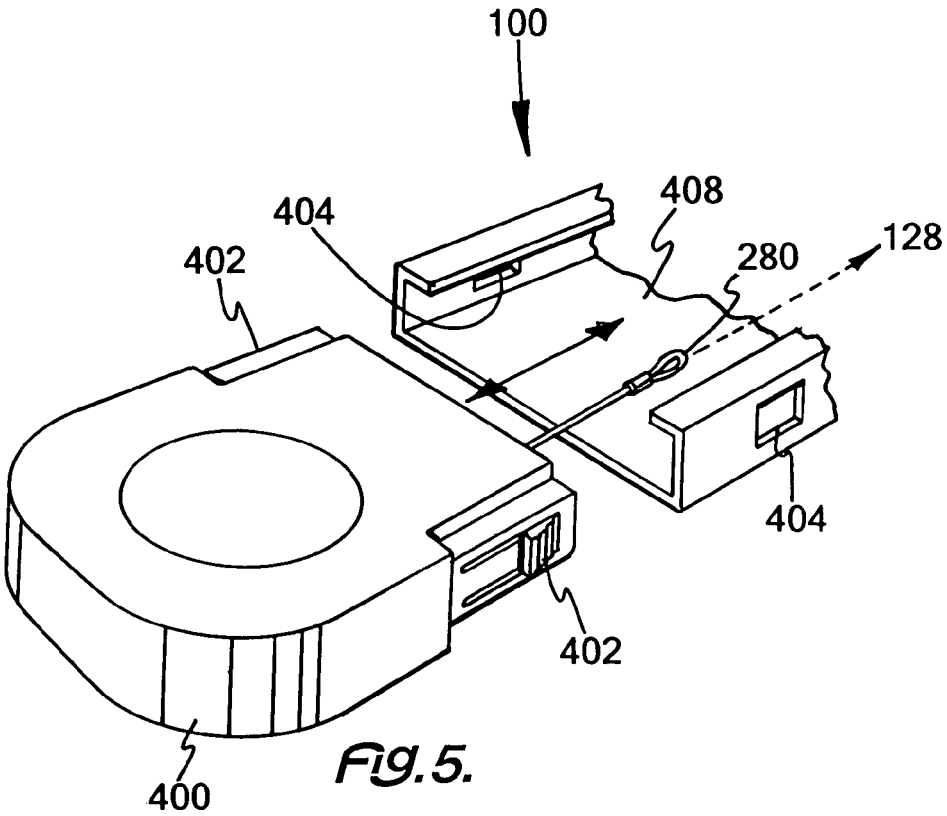
FIG. 5 depicts an assembled, perspective view of a resistance cassette assembly 400 of this invention being inserted into exercise device 100.

Within FIG. 5 is taught that either the stacked pulley over spring cassette assembly 200 or the spring inside pulley assembly 300 may be used with exercise device 100. The resistance cassette 400 slides into exercise device 100. The resistance cassette 400 may use any suitable device for attaching onto or fitting into exercise device 100. Thus, the resistance cassette 400 includes, but is not limited, to spring cassette assembly 200 or the spring inside pulley assembly 300.

Resistance cassette 400 includes locking tabs 402 on either side. Each locking tab 402 mates with its own tab receiver 404 within the cassette receiver 408 on exercise device 100. Cable end 280 receives exercise modules 128 of exercise device 100.

To remove the resistance cassette 400 from the cassette receiver 408, cable end 280 is removed from exercise modules 128, the locking tabs 402 are pushed inwardly and released from tab receivers 404, disengaging resistance cassette 400 and permitting it to be pulled from the exercise device 100.

Figure 6:
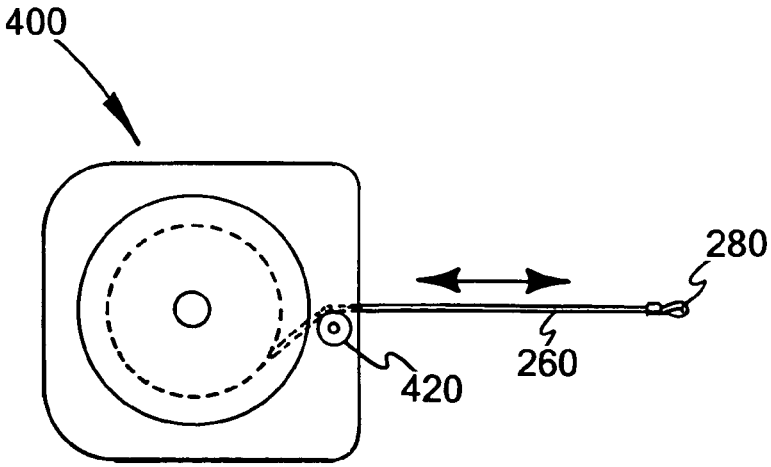
FIG. 6 depicts a top, partially cross-sectioned view of resistance cassette assembly 400, as used in FIG. 5.

Referring now to FIG. 6, roller 420 may be mounted into resistance cassette 400 so that flexible cable 260 and cable end 280 may function more efficiently with exercise device 100. More specifically, roller 420 may be positioned along the centerline of resistance cassette 400 in order to move thrust of the flexible cable 260 to simplify assembly and reassembly of the resistance cassette 400 with exercise device 100.

Figure 7:
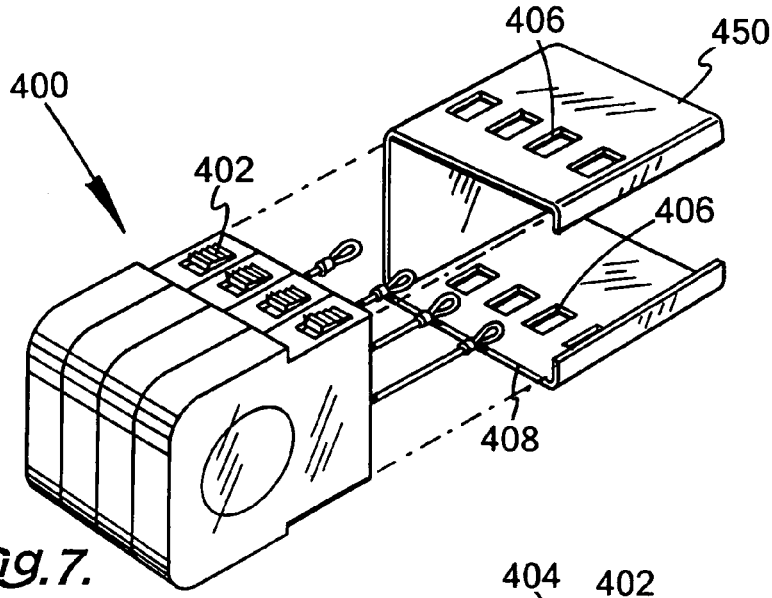
FIG. 7 depicts a perspective view of stacked combining bracket 450.
Figure 8:
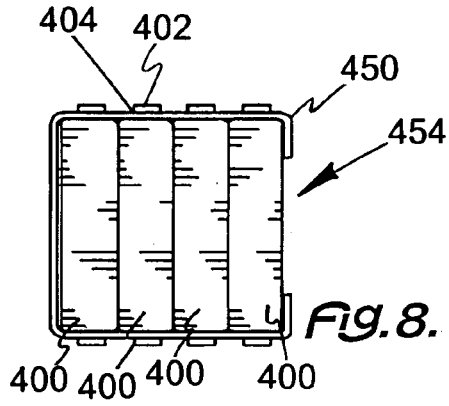
FIG. 8 depicts an end horizontal view 452 of stacked combining bracket 450.
Figure 9:
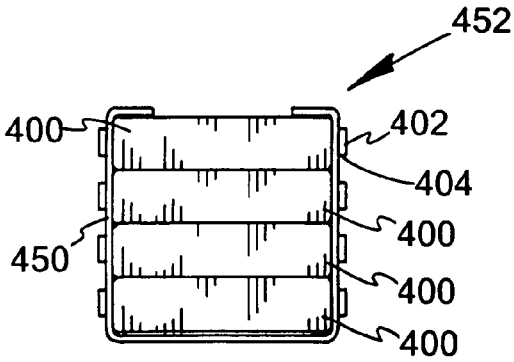
FIG. 9 depicts an end vertical view 454 of stacked combining bracket 450.

Adding FIG. 7, FIG. 8, and FIG. 9 to the consideration, joining of one resistance cassette 400 to another resistance cassette 400 clearly becomes possible. Thus, the resistance of one resistance cassette 400 may be added to another. With such addition, multiple resistance cassettes 400 may be required to achieve the desired range of exercise resistance.

With FIG. 8 depicting an end horizontal view 452 of stacked combining bracket 450 and FIG. 9 depicting an end vertical view 454 of stacked combining bracket 450, each resistance cassette 400 with locking tabs 402 fits into mounting device 404. Tab receivers 406 (FIG. 7 exist in pairs on cassette receiver 408 in order to receive as many cassettes as possible.

Figure 10:
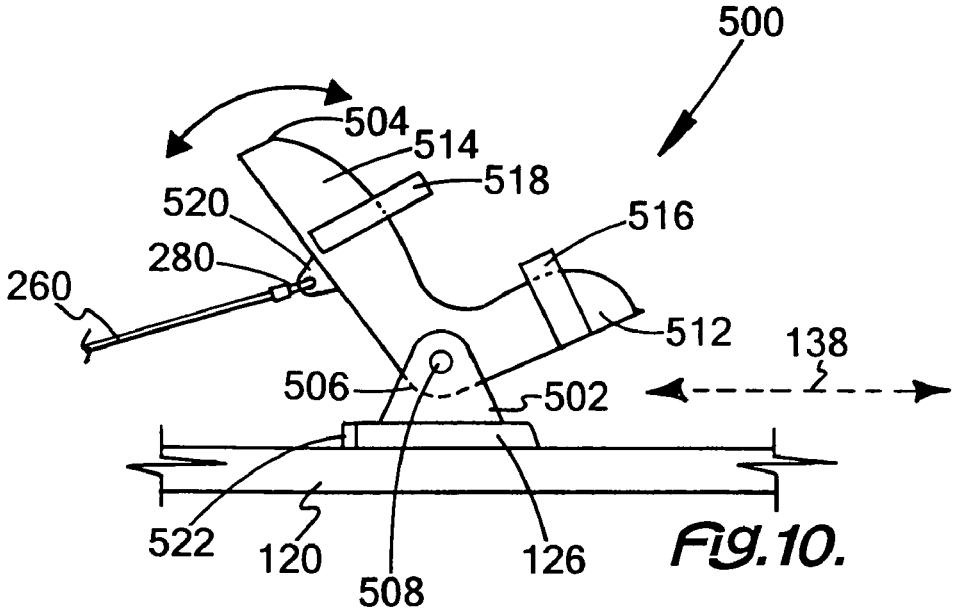
FIG. 10 depicts a side view of housing 120 for the exercise device 100 of this invention with ankle/foot exercise fixture 500 thereon.

In FIG. 10, housing 120 for the exercise device 100 has an ankle/foot exercise fixture 500 thereon. Exercise receiver 172 (FIG. 2) holds the pin bracket 502 for ankle/foot exercise fixture 500. Extending from pin bracket 502 is foot housing 504. Foot housing 504 fits into a mounting slot 506 with a mounting pin 508 to hold foot housing 504 therein.

Foot housing 504 includes a sole support 512 extending into a calf support 514. Sole strap 516 and calf strap 518 may hold the foot and leg of a person (not shown) therein. With cable end 280 of cable 260 attached to fitting 520 of ankle/foot exercise fixture 500, a patient can exercise their ankle or foot as desired by a physician. Also, locking hub 522 can secure movable carriage 126 so that the foot exercise fixture 500 does not slide within housing 120 if so desired.

Figure 11:
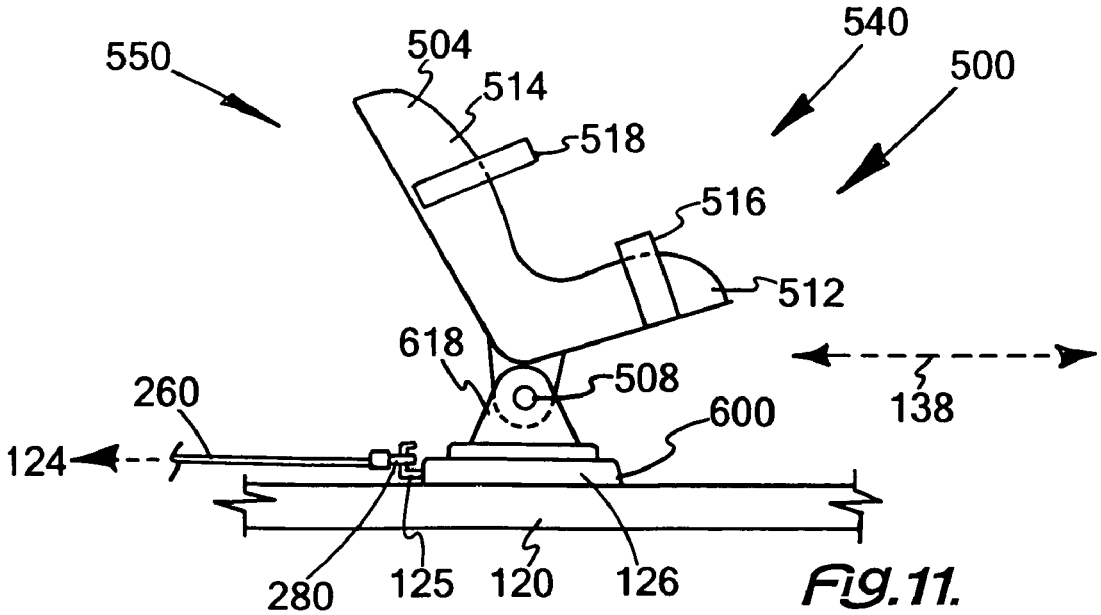
FIG. 11 depicts a side view of housing 120 for the exercise device 100 of this invention with knee/leg exercise fixture 540 thereon.

In FIG. 11 the use of the ankle/foot exercise fixture 500 as a knee/leg exercise fixture 540 is clear. Like ankle/foot exercise fixture 500, knee/leg exercise fixture 540 has a hub 600 releasably secured in movable carriage 126. However, knee/leg exercise fixture 540 is attached to the resistance cartridge 124 using cable end 280 attached to movable carriage hook 125 and knee/leg exercise fixture 540 is allowed to freely travel in horizontal direction 138.

Figure 12:
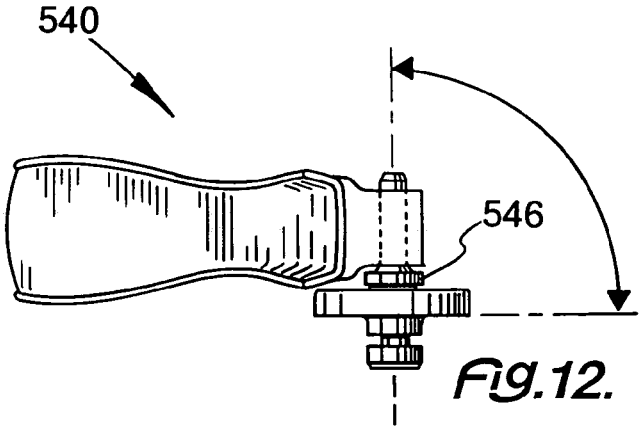
FIG. 12 depicts an end plan view of housing 120 for the exercise device 100 of this invention with knee/leg exercise fixture 540 thereon, based on FIG. 11 rotated ninety degrees about a vertical axis.
Figure 13:
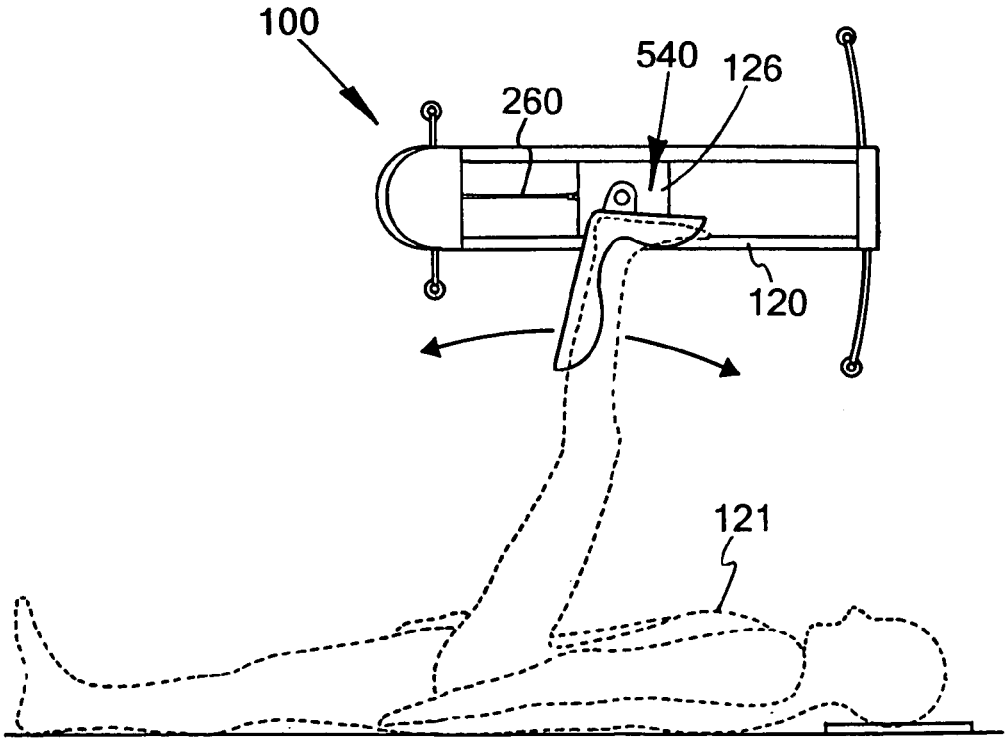
FIG. 13 depicts a top plan view of housing 120 for the exercise device 100 of this invention with a knee/leg exercise fixture 540 thereon, based on FIG. 11 rotated ninety degrees about a vertical axis.

Adding FIG. 12 and FIG. 13 to the consideration, the knee/leg exercise fixture 540, is mounted on 90 degree adapter 546 allowing knee/leg exercise fixture 540 to mount on movable carriage 126 substantially parallel to exercise housing 120 in order to exercise the knee, hip and leg as a person 121 can lie on a side and use exercise device 100.

Figure 14:
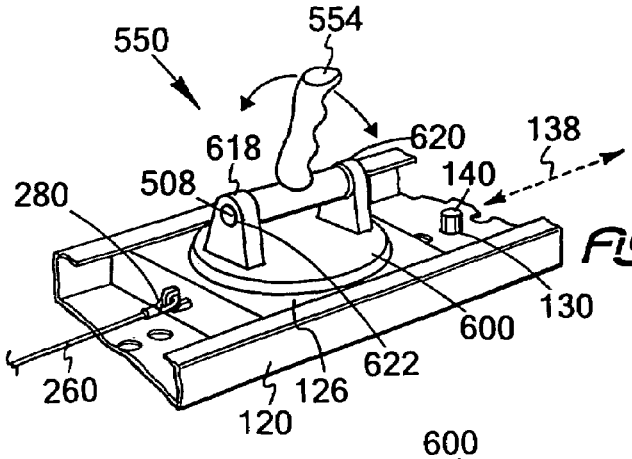
FIG. 14 depicts a perspective view of housing 120 for the exercise device 100 of this invention with arm/shoulder exercise fixture 550 thereon.

Adding FIG. 14, arm/shoulder exercise fixture 550 has a hub 600 releasably secured in movable carriage 126. When grip member 554 is attached to hub 600, which is further attached to movable carriage 126, grip member 554 is allowed to move along housing 120 in a horizontal direction 138. Preferably grip member 554 is free to rotate 15 degrees about a vertical axis. Housing 120 also has apertures 130 that allow pins 340 to be received and therefor limit the range of motion of movable carriage 126.

Figure 15:
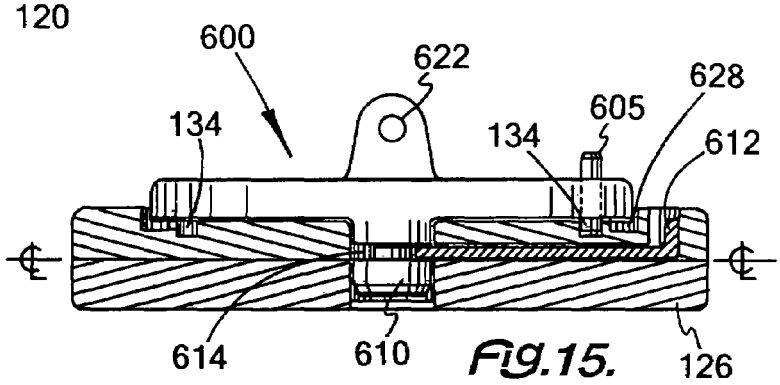
FIG. 15 depicts a side view of housing 120 for the exercise device 100 of this invention with hub 600 thereon.
Figure 16:
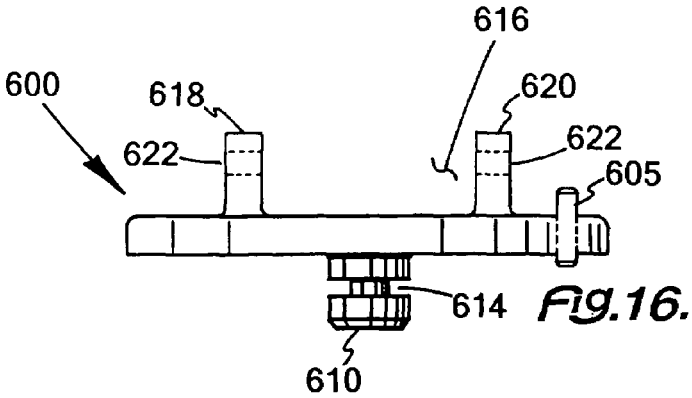
FIG. 16 depicts a front view of hub 600.

From FIG. 15 and FIG. 16, it becomes clear how housing 120 (FIG. 2) for the exercise device 100 can support a variety of exercise modules. Hub shaft 610 of hub 600 fits into movable carriage 126, and may move therewith or rotate therein as desired. Carriage lock 612 slides through movable carriage 126 into contact with hub notch 614 and allows for locking of hub 600 into movable carriage 126. Sliding of carriage lock 612 out of hub notch 614 also allows for removal of hub 600 from movable carriage 126.

Movable carriage 126 also includes carriage lock apertures 134. Carriage lock apertures 134 in combination with hub pins 605 allow hub 600 to be locked into different positions on movable carriage 126 at 90 degree increments. Hub 600 includes a housing slot 616 with a first wing 618 and a second wing 620 forming the slot 616 and having concentric pin apertures 622. Pin apertures 622 receive a locking pin in order to hold exercise module 128 (FIG. 1) therein. Hub 600 may be supported on thrust rings 628.

Figure 17:
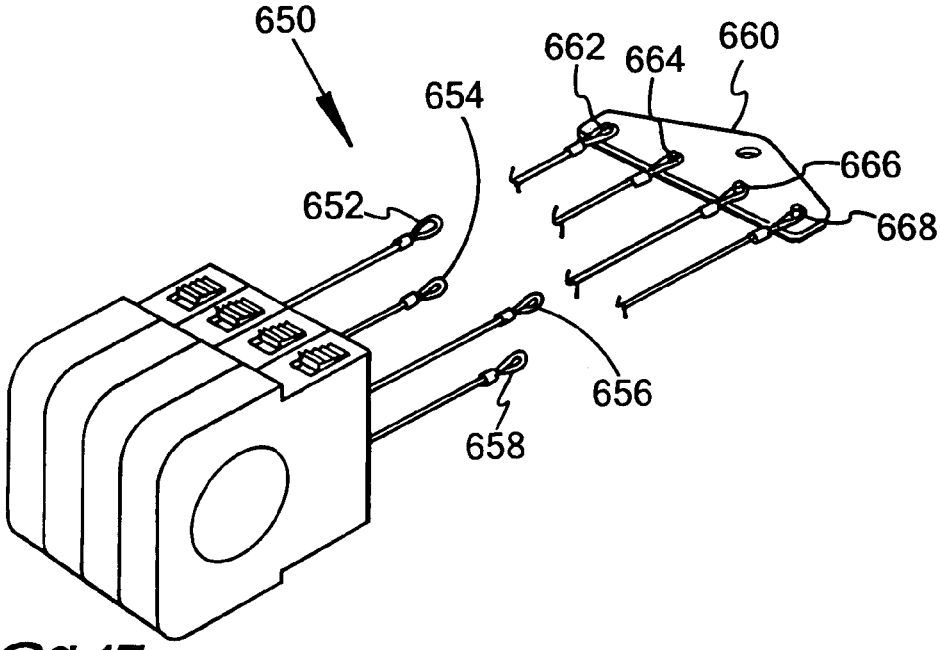
FIG. 17 depicts a perspective view of stacked wire cassette 650 of this invention.

Now considering FIG. 17, stacked wire cassette 650 may have a first cable end 652, a second cable end 654, a third cable end 656 and a fourth cable end 658. Each cable end may be connected in any number to cable plate 660 or to a separate exercise module if desired. Cable plate 660 includes, a first cable pin 662, a second cable pin 664, a third cable pin 666 and a fourth cable pin 668 may selectively receive one or more of the respective cable ends.

Figure 18:
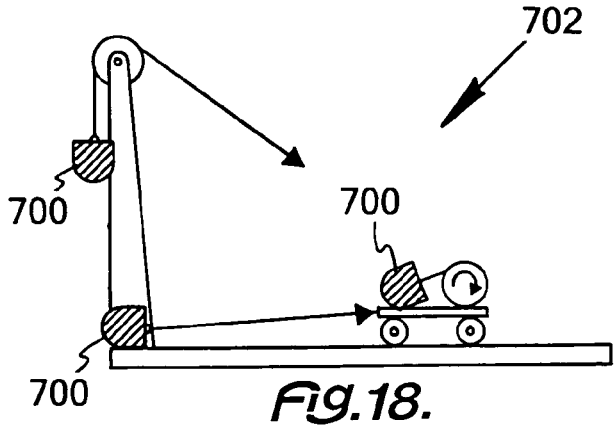
FIG. 18 depicts a multiple cassette housing 700 of this invention.

In FIG. 18, multiple cassette housing 700 has a modified exercise device 702. Multiple numbers of resistance cassette assembly 400 are mounted in different positions. In this manner, a number of different workouts can occur.

This application; taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. An exercise device with an adjustable exercise means for a part of a body or an adjustable exercise resistance, comprising;

(a) the exercise device including a device housing;

(b) the device housing having a resistance receiving means;

(c) the device housing having a exercise device receiving means;

(d) the resistance receiving means being adapted to receive at least one resistance device;

(e) the exercise device receiving means being adapted to receive a body part exercise fixture;

(f) the at least one resistance device providing an exercise resistance for a user of the exercise device;

(g) the at least one resistance device being at least a first resistance cassette and at least a second resistance cassette;

(h) the first resistance cassette providing a different resistance for the exercise device than the second resistance cassette;

(i) the body part exercise fixture being adapted to receive a body part and provide exercise therefor; and (j) the body part exercise fixture including a support means and a securing means for the body part to be releasably securable in the body part exercise fixture;

(k) the at least one resistance device having an outer casing;

(l) the outer casing having an indicating means to indicate a resistance for the at least one resistance device;

(m) a resistance means being within the outer casing in order to provide a weight effect for the exercise device;

(n) a movable carriage being mounted on the device housing;

(o) the movable carriage receiving the exercise fixture on an exercise side thereof:

(p) the movable carriage receiving the device housing on a carriage housing side thereof;

(q) the exercise side being oppositely disposed from the carriage housing side; and (r) a connecting means securing the movable carriage to the at least one resistance device.

2. The exercise device of claim 1 further comprising:

(a) a locking means for releasably securing the movable carriage in a desired position;

(b) the body part exercise fixture being adapted to secure a body part selected from the group consisting of an arm device, a shoulder device, a hip device, an ankle device, a knee device, a foot device and a leg device;

(c) the body part exercise fixture directing proper exercise; and (d) the at least one resistance device providing a prescribed weight for exercise.

3. The exercise device of claim 2 further comprising:

(a) the device housing having a fixed end and a sliding end;

(b) the device housing having a mounting support;

(c) the mounting support connecting the fixed end and the sliding end; and (d) the fixed end including a gripping device to releasably secure the exercise device in a desired position.

4. The exercise device of claim 3 further comprising:

(a) the fixed end including a pivot device;

(b) the pivot device permitting the device housing to move about the fixed end;

(c) the sliding end including a sliding bar;

(d) the sliding bar having a arc;

(e) the sliding end being movable along the sliding bar; and (f) the sliding end including movable along the sliding bar.

5. The exercise device of claim 4 further comprising:

(a) the fixed end including a pivot device;

(b) the mounting support having a sliding slot to receive sliding bar;

(c) the mounting support moving along the sliding bar at the sliding end while the fixed end is movable around the pivot device; and (d) the housing support including a first side rail and a second side rail.

6. The exercise device of claim 5 further comprising:

(a) a slide mender being mounted between the first side rail and the second side rail;

(b) the slide member having an exercise receiver centrally located therein;

(c) the exercise receiver receiving the body part exercise fixture; and (d) the resistance cartridge providing the exercise device with an appropriate resistance.

7. The exercise device of claim 6 further comprising:

(a) the resistance cartridge having a stacked pulley over spring assembly;

(b) the stacked pulley over spring assembly including an internal lower housing;

(c) the internal lower housing containing a resistance spring;

(d) the resistance spring having an outer end retained by an internal slot in the internal lower housing;

(e) a pulley assembly being mounted in the internal lower housing;

(f) the pulley assembly including a pulley mounted on a shaft; and (g) an upper housing cooperating with the lower housing to complete the pulley assembly.

8. The exercise device of claim 7 further comprising:

(a) the pulley having a hub;

(b) the hub receiving a flexible cable;

(c) the flexible cable permitting the resistance cartridge to operably connected to the exercise device;

(d) the resistance spring being a circular spring wound upon itself.

9. The exercise device of claim 6 further comprising:

(a) the resistance cartridge having a spring inside pulley assembly;

(b) the spring inside pulley assembly including a slotted pulley;

(c) the spring inside pulley assembly including a slotted pulley;

(d) the slotted pulley having a center aperture to receive a fixed shaft;

(e) the slotted pulley including a spring receiver to hold a resistance spring therein;

(f) the slotted pulley including an edge spring slot to receive an outer end of the resistance spring;

(g) the spring inside pulley assembly having an outer slot lower housing; and (h) the slotted pulley having the resistance spring aver the fixed shaft in the pulley housing.

10. The exercise device of claim 6 further comprising:

(a) the resistance cassette having locking tabs on either side thereof;

(b) the exercise device including a cassette receiver on the exercise device;

(c) the cassette receiver having tab receivers for receiving the locking tabs on at least two resistance cassettes; and (d) a roller positioned in the resistance cassette to facilitate the flexible cable and a cable end.

11. The exercise device of claim 6 further comprising:

(a) the exercise device having an ankle or foot exercise fixture in the exercise receiver;

(b) the exercise receiver holding a pin bracket for the ankle or foot exercise fixture;

(c) a foot housing of the ankle or foot exercise fixture extending from the pin bracket;

(d) the foot housing fitting into a mounting slot on the pin bracket with a mounting pin to hold the foot housing therein;

(e) the foot housing including a sole support;

(f) the sole support extending into a calf support; and (g) a securing means being suitable for holding a foot in the ankle or foot exercise fixture.

12. The exercise device of claim 6 further comprising:

(a) the exercise device having a knee or leg exercise fixture;

(b) the knee or leg exercise fixture having a hub releasably secured in the movable carriage;

(c) the resistance cartridge having a cable end attached to a movable carriage hook, thereby allowing knee or leg exercise fixture to freely travel in horizontal direction;

(d) the movable carriage hook being secured to the movable carriage; and (e) the movable carriage hook connecting the resistance cartridge to the knee or leg exercise fixture.

13. The exercise device of claim 6 further comprising:

(a) the exercise device having an arm or shoulder exercise fixture;

(b) the arm or shoulder exercise fixture having a hub realizable secured in the movable carriage;

(c) the resistance cartridge having a cable end attached to a movable carriage hook, thereby allowing knee or leg exercise fixture to freely travel in horizontal direction;

(d) the movable carriage hook being secured to the movable carriage; and (e) the movable carriage hook connecting the resistance cartridge to the arm or shoulder exercise fixture.

14. The exercise device of claim 13 further comprising:

(a) the exercise device having an arm or shoulder exercise fixture having a hub releasably secured in the movable carriage;

(b) the arm or shoulder exercise fixture having a grip member;

(c) the grip member being movable along the housing in a horizontal direction; and (d) the grip member being free to move about a vertical axis; and (e) a pin means restricting a movement of the grip member.

* * * * *